United States Patent [19]

Zarov

[11] 4,426,003

[45] Jan. 17, 1984

[54] DRAIN CLEANER PACKAGE

[76] Inventor: Jack Zarov, 9228 N. Kildare Ave., Skokie, Ill. 60076

[21] Appl. No.: 346,499

[22] Filed: Feb. 8, 1982

[51] Int. Cl.[3] ..... B65D 85/84

[52] U.S. Cl. ..... 206/524.4; 134/22.13; 206/524.5; 252/90; 422/41; 422/42; 422/43

[58] Field of Search ..... 252/90; 134/22 C, 22.13; 206/524.4, 524.5; 422/41, 42, 43

[56] References Cited

U.S. PATENT DOCUMENTS

| | | | |
|---|---|---|---|
| 52,910 | 2/1866 | Taylor | 206/524.4 |
| 686,842 | 11/1901 | Byrnes | 252/90 |
| 929,610 | 7/1909 | Lilly | 206/524.4 |
| 2,170,644 | 8/1939 | Nelson | 422/43 |
| 3,061,549 | 10/1962 | Dickey | 252/90 |
| 3,533,955 | 10/1970 | Pader et al. | 252/153 |
| 3,819,036 | 6/1974 | Weldon | 206/524.5 |
| 4,348,292 | 9/1982 | Ginn | 252/135 |

*Primary Examiner*—John E. Kittle
*Assistant Examiner*—Mukund J. Shah
*Attorney, Agent, or Firm*—Dressler, Goldsmith, Shore, Sutker & Milnamow, Ltd.

[57] ABSTRACT

A drain cleaner package which reduces the hazards of handling a caustic material, such as sulfuric acid, or an aqueous alkali metal hydroxide solution in a container by providing a layer of immiscible liquid in the container above the caustic material. In a preferred embodiment, the container is a bottle with a narrowed neck.

11 Claims, 1 Drawing Figure

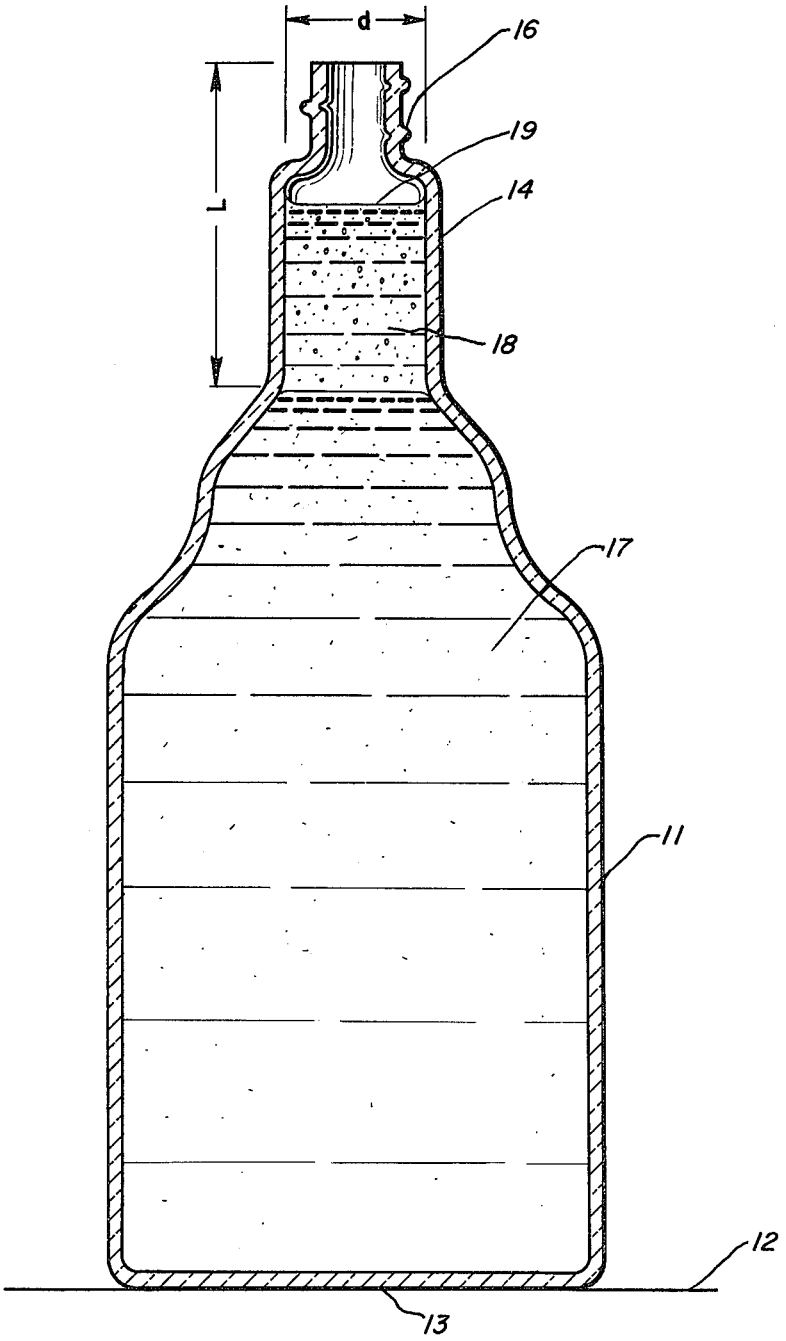
d
16
19
14
L
18
17
11
12
13

DRAIN CLEANER PACKAGE

TECHNICAL FIELD

This invention relates to drain cleaner packages, and particularly to packages of liquid drain cleaner materials, such as sulfuric acid, or aqueous solutions of sodium hydroxide or potassium hydroxide.

BACKGROUND OF THE INVENTION

Liquid drain cleaners are widely used to clean stopped drains by dissolving or softening common clogging materials as well as generating heat in the clogged material.

The most commonly used liquid drain cleaners are strongly alkaline aqueous solutions of sodium or potassium hydroxide. For drains which are particularly difficult to clear, concentrated sulfuric acid may be used.

There are hazards in the handling of drain cleaner liquids, and particularly in the handling of concentrated sulfuric acid which is highly caustic and corrosive to skin and other tissues.

The packaging of sulfuric acid drain cleaners in "unbreakable" bottles made of a resilient corrosion resistant plastic material, such as polyethylene, reduces the hazards associated with accidental breakage, but other hazards remain.

When an unstoppered bottle of concentrated sulfuric acid is dropped, or set down hard, on a horizontal surface, such as a table, tiny droplets of the acid may rise from the surface of the liquid and may thereafter come into contact with the skin or eyes of the handler. Contact with the eyes can be particularly harmful.

In addition, the accidental tipping of a bottle of concentrated sulfuric acid can be harmful to the table top or other surfaces on which the bottle is resting, even if the bottle is quickly set upright.

There is also a potential hazard in the use of caustic drain cleaners, particularly sulfuric acid drain cleaners, by reason of localized overheating which may lead to boiling. Although sulfuric acid is miscible with water, it tends to remain separate, by reason of its much higher density, and to sink to the bottom of a clogged drain to the extent permitted by the stoppage therein. In this position, there is a considerable amount of heat developed at the interface between the sulfuric acid layer and the water layer; and localized boiling may occur causing acid-containing water to emerge as droplets from the liquid-air interface. If the user is nearby to observe the operation of the drain cleaner, he may possibly be spattered by erupting acid-containing water.

SUMMARY OF THE INVENTION

In accordance with this invention, there is provided a drain cleaner package comprising a fluid container adapted to rest on a horizontal surface and having a flat bottom and a sealable opening at the top, a body of caustic liquid within said container and a layer of immiscible liquid above said caustic liquid, said immiscible liquid being of lower density than said caustic liquid and substantially inert thereto.

Preferably, the fluid container comprises a substantially cylindrical bottle with a narrow neck having a length at least as great as its internal diameter, and most preferably at least 1.5 times as great.

The immiscible liquid is preferably a mineral oil, and most preferably a heavy mineral oil. However, any non-volatile liquid may be used which is immiscible with the caustic liquid and inert thereto and lower in density. In addition to mineral oil, other hydrocarbon materials may be used, such as kerosene, fuel oil, and synthetic crude oil, as well as halogenated hydrocarbons, silicone oils, and stable, oily oxygenated hydrocarbons, such as high molecular weight ethers.

The invention is most useful when the caustic liquid is concentrated sulfuric acid because the handling of sulfuric acid is particularly hazardous. However, the invention is also useful with highly alkaline caustic materials, such as sodium and potassium hydroxides.

DESCRIPTION WITH REFERENCE TO THE DRAWING

The invention may be understood more clearly with reference to the single FIGURE which is an elevation in cross section of the drain cleaner package of this invention.

As may be seen in the FIGURE, bottle 11, made of polyethylene, is generally cylindrical in shape, and rests on table top 12, making contact therewith at flat bottom 13.

The top of bottle 11 tapers toward narrow neck 14 which is substantially circular in cross section. Neck 14 is further restricted at its upper end and has external thread 16 to receive a cap (not shown) which seals the container. The length of the neck 1 (including the further restricted cap portion) is at least equal to the inner diameter d.

Within bottle 11, concentrated sulfuric acid (96%) forms body 17 filling most of the cavity within the bottle. Above body 17, layer 18 of heavy mineral oil floats and fills a portion of neck 14.

In normal use, the entire contents of bottle 11 is poured into a clogged drain; and the sulfuric acid acts on the clogging material to dissolve, soften and heat it as in the normal usage of sulfuric acid in a drain cleaner. The mineral oil, present in a relatively small quantity does not impair the clog clearing ability of the sulfuric acid. Moreover, the mineral oil, poured into the clogged drain with the sulfuric acid, tends to rise to the top of the liquid in the drain and to form a protective layer thereon. The protective layer tends to minimize localized boiling and, in the event of boiling, tends to assure that what emerges from the liquid-air interface will be oil droplets rather than acid water droplets.

Should bottle 11, without a cap, be dropped or set down hard on a horizontal surface, such as table top 12, tiny droplets of liquid may rise from upper surface 19, but the droplets from the upper surface would be harmless droplets of oil, rather than caustic droplets of sulfuric acid.

In the event that bottle 11, without a cap, is accidentally tipped over, the first liquid to pour out of the neck will be mineral oil; and the corrosive effects of sulfuric acid can be avoided if the bottle is quickly set upright.

Typically, bottle 11 may contain from about 300 to about 500 milliliters of concentrated sulfuric acid and from about 5 to about 30 milliliters of mineral oil, or from about 1 to about 10 volume percent of the caustic liquid. In a neck of about 25 milliliter diameter, each milliliter of oil forms a layer about 2 millimeters in thickness. Thus 5 milliliters of oil will form, in such a neck, an oil layer of about 10 millimeter thickness. On the other hand, 30 milliliters of oil is likely to extend the oil layer below the neck and into the shoulder of the container where increase in oil volume is not proportional to the increase in the thickness of the oil layer.

In one specific embodiment, bottle 11 is made of polyethylene and is molded to hold about 375 ml. of liquid leaving a small space in the neck of the bottle, as shown. The inner diameter of the neck of the bottle is about 2.5 cm. The inner diameter of the neck at the further restricted cap portion is about 1.6 cm.; and the length of the neck (including the cap portion) is about 4.0 cm. The ratio of neck length to inner diameter in this case is 4.0/2.5, or 1.6.

Other chemically inert plastic materials, such as polypropylene, or polyvinyl chloride may be used, if desired, in place of polyethylene.

The invention has been described with respect to a preferred embodiment. Those skilled in the art will understand that modifications and variations may be employed without departing from the essence of the invention.

I claim:

1. A drain cleaner package comprising a fluid container adapted to rest on a horizontal surface and having a flat bottom and a sealable opening at the top, a body of caustic liquid within said container and a layer of immiscible liquid being of lower density than said caustic liquid and substantially inert thereto.

2. The drain cleaner package of claim 1 wherein said caustic liquid is concentrated sulfuric acid.

3. The drain cleaner package of claim 1 wherein said caustic liquid is a concentrated aqueous solution of sodium hydroxide.

4. The drain cleaner package of claim 1 wherein said caustic liquid is a concentrated aqueous solution of potassium hydroxide.

5. The drain cleaner package of claim 1 wherein said immiscible liquid is a mineral oil.

6. The drain cleaner package of claim 1 wherein said immiscible liquid is a halogenated hydrocarbon.

7. The drain cleaner package of claim 1 wherein said container comprises a corrosion resistant resilient material.

8. The drain cleaner package of claim 7 wherein said container comprises polyethylene.

9. The drain cleaner package of claim 1 wherein said container comprises a substantially cylindrical bottle with a narrow neck having a length at least as great as its internal diameter.

10. The drain cleaner package of claim 1 wherein said layer of immiscible liquid is at least about 10 millimeters in thickness.

11. The drain cleaner package of claim 1 wherein said body of caustic liquid is from about 300 to about 500 milliliters.

* * * * *

UNITED STATES PATENT AND TRADEMARK OFFICE

CERTIFICATE OF CORRECTION

PATENT NO. : 4,426,003

DATED : January 17, 1984

INVENTOR(S) : JACK ZAROV

It is certified that error appears in the above-identified patent and that said Letters Patent is hereby corrected as shown below:

Column 3, line 27, delete --being--.

Signed and Sealed this

*Ninth* Day of *April 1985*

[SEAL]

*Attest:*

DONALD J. QUIGG

*Attesting Officer* *Acting Commissioner of Patents and Trademarks*